US012338192B2

(12) United States Patent
Little et al.

(10) Patent No.: US 12,338,192 B2
(45) Date of Patent: Jun. 24, 2025

(54) SYNTHESIS OF HIGH EXPLOSIVE NANOPARTICLES BY TURBULENT MIXING

(71) Applicant: Government of the United States, as represented by the Secretary of the Air Force, Wright-Patterson AFB, OH (US)

(72) Inventors: Brian K. Little, Niceville, FL (US); Dylan K. Smith, Fort Walton Beach, FL (US); Christopher A. Crouse, Valparaiso, FL (US); Dylan T. Slizewski, Colorado Springs, CO (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 849 days.

(21) Appl. No.: 17/456,915

(22) Filed: Nov. 30, 2021

(65) Prior Publication Data

US 2022/0259118 A1 Aug. 18, 2022

Related U.S. Application Data

(60) Provisional application No. 63/120,266, filed on Dec. 2, 2020.

(51) Int. Cl.
*C06B 21/00* (2006.01)
*C06B 25/34* (2006.01)

(52) U.S. Cl.
CPC ..... *C06B 21/0008* (2013.01); *C06B 25/34* (2013.01)

(58) Field of Classification Search
None
See application file for complete search history.

(56) References Cited

U.S. PATENT DOCUMENTS 5,197,677 A 3/1993 Estabrook et al.
2009/0107593 A1* 4/2009 Lee ..... C06B 25/34 149/92

FOREIGN PATENT DOCUMENTS

IL 100231 * 1/1995

OTHER PUBLICATIONS

Ultra-High Throughput Synthesis of Nanoparticles with Homogeneous Size Distribution Using a Coaxial Turbulent Jet Mixer, Lim (Year: 2014).*
Clairmont, A.R., et al., The Detonation Behavior of Ammonium Perchlorate as a Function of Charge Density and Diameter, NOLTR 61-71, United States Naval Ordnance Laboratory, 1967.
Price, D., et al., Particle Size Effect on Explosive Behavior of Ammonium Perchlorate, NOLTR 61-112, United States Naval Ordnance Laboratory, 1967.

(Continued)

*Primary Examiner* — Aileen B Felton
(74) *Attorney, Agent, or Firm* — AFMCLO/JAZ

(57) ABSTRACT

A method of making RDX nanoparticles comprises dissolving RDX in acetone; injecting the RDX/acetone through an inner tube of a turbulent mixer to form an inner flow; injecting an anti-solvent through an outer tube of a turbulent mixer to form an outer flow, wherein the inner tube is concentric with the outer tube, wherein turbulent mixing of the inner flow and outer flow precipitates nanoparticle of RDX. The concentration of RDX in acetone may be 0.5-1.0 mg RDX/mL acetone. The anti-solvent is a mixture of hexane and cyclohexanone.

4 Claims, 4 Drawing Sheets

Schematic of coaxial turbulent jet mixer

(56) References Cited

OTHER PUBLICATIONS

Liu, J. et al., Study of nano-nitramine explosives: preparation, sensitivity and application, Defence Technology 10 (2014) 184-189.
Liu, J. et al., Effect of Drying on Particle Size and Sensitivities of Nano hexahydro-1,3,5-trinitro-1,3,5-triazine, Defence Technology 10 (2014) 9-16.
Dou, H., et al., Preparation and characterization of cyclo-1,3,5-trimethylene-2,4,6-trinitramine (RDX) powder: Comparison of microscopy, dynamic light scattering and field-flow fractionation for size characterization, Powder Technology 235 (2013) 814-822.
Tillotson, T.M., et al., Nanostructured energetic materials using sol-gel methodologies, Journal of Non-Crystalline Solids 285 (2001) 338-345.
Stepanov, V., et al., Production of Nanocrystalline RDX by Rapid Expansion of Supercritical Solutions, Propellants, Explosives, Pyrotechnics 30 (2005), No. 3.
Bayat, Y., et al., Statistical optimization of supercritical carbon dioxide antisolvent process for preparation of HMX nanoparticles, J. of Supercritical Fluids 72 (2012) 248-254.
Lee, B., et al., Preparation of Micronized β-HMX Using Supercritical Carbon Dioxide as Antisolvent, dx.doi.org/10.1021/ie102593p | Ind. Eng. Chem. Res. 2011, 50, 9107-9115.
Kaur, J., et al., Evaluation of Ultrasonic Treatment for the Size Reduction of HNS and HMX in Comparison to Solvent-Antisolvent Crystallization, Propellants Explos. Pyrotech. 2012, 37, 662-669.
Patil, M.N., et al., Ultrasonically controlled particle size distribution of explosives: A safe method, Ultrasonics Sonochemistry 15 (2008) 177-187.
Wang, J., et al., Study on Ultrasound- and Spray-Assisted Precipitation of CL-20, Propellants Explos. Pyrotech. 2012, 37, 670-675.
Radacsi, N., et al., Electrospray Crystallization for High-Quality Submicron-Sized Crystals, Chem. Eng. Technol. 2011, 34, No. 4, 624-630.
Kumar, R., et al., Preparation of Nano-RDX by Evaporation Assisted SolventAntisolvent Interaction, Propellants Explos. Pyrotech. 2014, 39, 383-389.
Kumar, R., et al., Optimized Synthesis of HMX Nanoparticles Using Antisolvent Precipitation Method, Journal of Energetic Materials, 33: 277-287, 2015.
Pessina, F., et al., The longstanding challenge of the nanocrystallization of 1,3,5-trinitroperhydro-1,3,5-triazine (RDX), Beilstein J. Nanotechnol. 2017, 8, 452-466.
Lim, J., et al., Ultra-High Throughput Synthesis of Nanoparticles with Homogeneous Size Distribution Using a Coaxial Turbulent Jet Mixer, ACS Nano, vol. 8 , No. 6, 6056-6065, 2014.

* cited by examiner

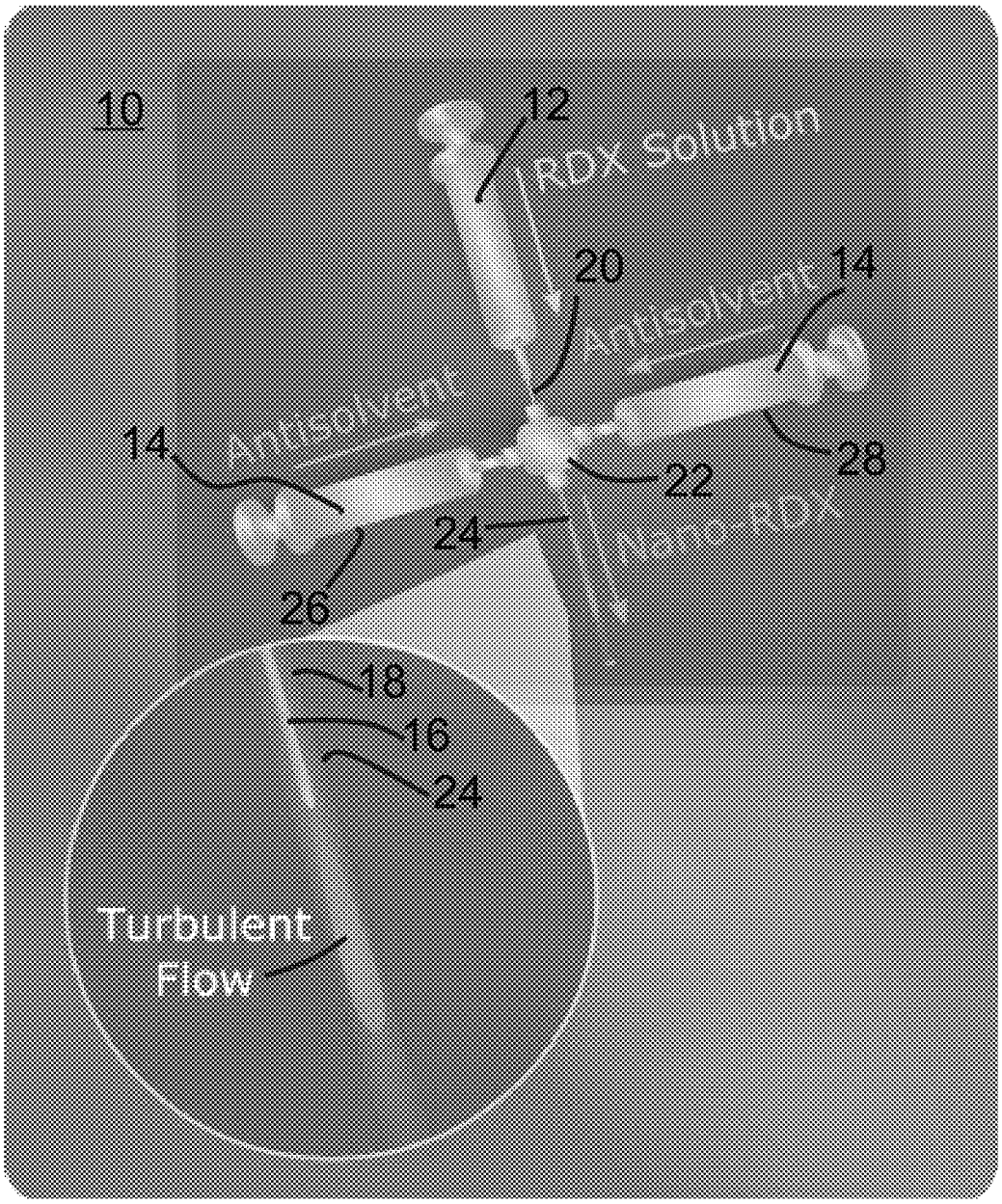
*Figure 1. Schematic of coaxial turbulent jet mixer*

*Figure 2.* *(a)* *Average particle diameter as a function of concentration (mg RDX/mL acetone) of inner solvent.* *(b)* *Representative particle size distribution of concentrations used in Fig 2a.* *(c)* *SEM image of the 0.5 mg/ml sample representative of all SEM for concentrations less than 1 mg RDX/mL acetone.* *(d)* *2X magnification image of Fig 2c.*

*Figure 3.* *Representative image of rods seen in samples with concentrations higher than 1.0 mg RDX/mL acetone*

SYNTHESIS OF HIGH EXPLOSIVE NANOPARTICLES BY TURBULENT MIXING

Pursuant to 37 C.F.R. § 1.78(a)(4), this application claims the benefit of and priority to prior filed Provisional Application Ser. No. 63/120,266, filed 2 Dec. 2020, which is expressly incorporated herein by reference.

RIGHTS OF THE GOVERNMENT

The invention described herein may be manufactured and used by or for the Government of the United States for all governmental purposes without the payment of any royalty.

FIELD OF THE INVENTION

The present invention relates generally to the manufacture of nano-scale nitramine particles and, more particularly, to the manufacture of nano-scale nitramine particles using a turbulent mixing technique.

BACKGROUND OF THE INVENTION

Developing explosives with increased performance along with reduced sensitivity is a major objective in the energetic materials community. Reducing the particle size of energetic materials (EM) is one approach that can strongly influence the reactivity and sensitivity of the constituents.

For example, fine particles of ammonium perchlorate (AP) are more detonable than coarse particles. This disclosure is directed to nanometer-size high explosive (HE) particles which have gained increased attention due to their reduced sensitivity to ignition via friction, impact, and electrostatic discharge as compared to micrometer size particles. Many techniques have been used to reduce the particle size of HE including wet grinding, bidirectional grinding, sol-gel methods, supercritical fluid methods, ultrasonication, spray assisted precipitation, and solvent-antisolvent interaction. Many of these approaches are batch procedures that are labor intensive and cost prohibitive on an industrial scale.

SUMMARY OF THE INVENTION

The present invention overcomes the foregoing problems and other shortcomings, drawbacks, and challenges of manufacturing nanometer-size high explosive materials. While the invention will be described in connection with certain embodiments, it will be understood that the invention is not limited to these embodiments. To the contrary, this invention includes all alternatives, modifications, and equivalents as may be included within the spirit and scope of the present invention.

According to one embodiment of the present invention a method of making RDX nanoparticles comprises dissolving RDX in acetone; injecting the RDX/acetone through an inner tube of a turbulent mixer to form an inner flow; injecting an anti-solvent through an outer tube of a turbulent mixer to form an outer flow, wherein the inner tube is concentric with the outer tube, wherein turbulent mixing of the inner flow and outer flow precipitates nanoparticle of RDX.

The concentration of RDX in acetone may be 0.5-1.0 mg RDX/mL acetone.

The anti-solvent may be a mixture of hexane and cyclohexanone.

The ratio of hexane:cyclohexanone may be between 8:1-12:1.

The invention may be employed to produce nanoparticles of HMX, CL-20, PYX, and HNS using the same solvent/anti-solvent system described herein.

The solvent/anti-solvent systems are not restricted to those presented herein. Acetone may be replaced with other polar, aprotic solvents or solvent mixtures. Hexanes may be replaced with another non-polar or low polarity solvent or solvent mixtures. Cycicohexanone may be replaced with other known surfactants or surface stabilizing ligands to prevent agglomeration, control average particles size distributions, particle morphology and aspect ratio.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

FIG. 1 illustrates a coaxial turbulent jet mixer.

Figure 2A:
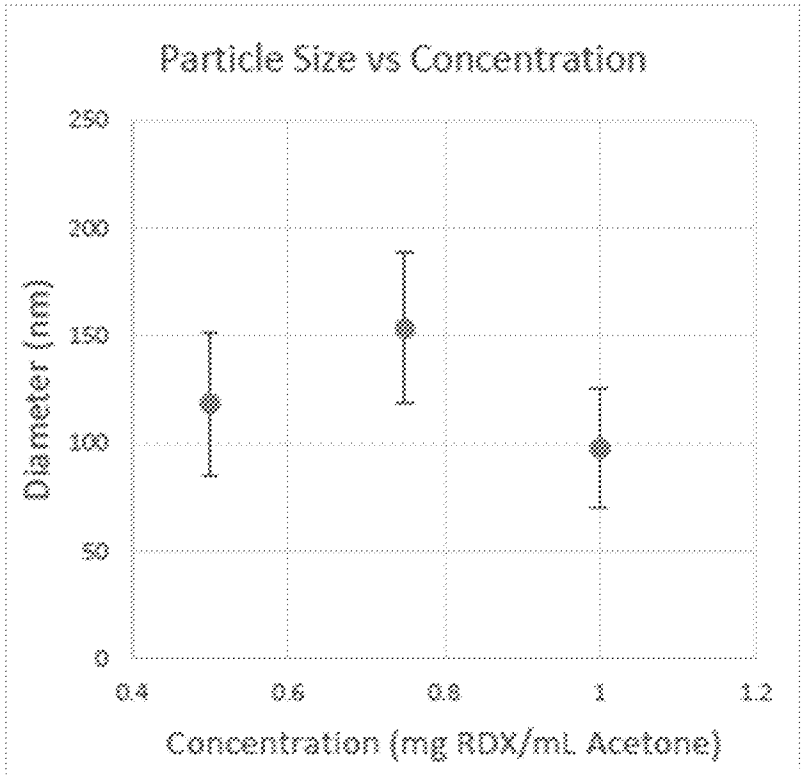
FIG. 2A presents the average particle size of RDX to acetone concentrations of 0.5, 0.75 and 1.0 mg/mL.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

This synthesis method creates nano-scale nitramine particles using a turbulent mixing technique. In this method, bulk nitramine high explosive (HE) particles are dissolved in a solvent and crash precipitated from solution into an anti-solvent mixture via a turbulent jet. The turbulent flow facilitates rapid mixing of solvent and anti-solvent streams. The rapid mixing and subsequent self-assembly of HE precursor forms homogeneous nanoscale nitramine particles.

Coaxial turbulent jet mixing technology was successfully adapted to facilitate production of nanometer scale RDX particles (RDX NPs), which is scalable for industrial applications.

RDX nanoparticles (NPs) with an average diameter of 123±28 nm were produced at a rate of 0.6 g/hour using a coaxial turbulent jet mixer. RDX was dissolved in acetone and precipitated into an anti-solvent mixture of 90% hexane and 10% cyclohexanone. Cyclohexanone was used as a surfactant to stabilize the NPs and prevent agglomeration; NPs of RDX were only observed when cyclohexane was added to Hexane in the anti-solvent solution. In the concentration range tested, 0.5, 0.75, 1, 1.5, and 2 mg RDX/mL acetone, only the lowest three concentrations formed NPs with very little difference in the average particle size. The two higher concentrations formed micron scale rod shaped particles. The coaxial turbulent jet mixer makes possible a scalable continuous flow solvent/antisolvent method for the production of NPs with a tunable size, morphology and aspect ratio and demonstrates industrial scale production of nano-RDX.

The coaxial turbulent jet mixer utilizes anti-solvent precipitation to rapidly reduce the solubility of a dissolved solid in a turbulent flow. Turbulent flow conditions result in rapid and efficient mixing with the anti-solvent yielding a dramatic reduction in solubility of the RDX causing precipitation the dissolved solid. Due to the near instantaneous precipitation and diffuse concentration of RDX in the anti-solvent the process yields precipitates of the dissolved solid with dimensions on the nano-scale.

Briefly, crystallization can be broken down into two steps, nucleation and growth. Increasing the number of nucleation points and reducing the growth time will lead to a reduction in particle size. Injecting the dissolved NP precursor into a turbulent flow of anti-solvent increases the number of nucleation points and decreases characteristic mixing time, leading to the formation of NPs.

The turbulent mixing apparatus 10 is shown in FIG. 1 and consists of an inner tube 16 inserted into a larger outer tube 18 in a coaxial arrangement to facilitate flow around the inner tube. The inner tube 16 is in fluid communication with a nanoparticle (NP) precursor supply 12, e.g. RDX dissolved in acetone. The outer tube 18 is in fluid communication with an anti-solvent supply 14. Flow of the precursor supply 12 through the inner tube 16, i.e. inner flow, is injected into or through the flow of the anti-solvent supply 14 from the outer tube 18. The anti-solvent flow around the inner tube creates a turbulent flow that rapidly precipitates the dissolved nanoparticle precursor to create nanoparticles of the precursor. The flow rates of the RDX dissolved in acetone and the anti-solvent may be varied to change the Reynolds number (RE) and the flow regime (laminar versus turbulent). Additionally, the flow velocity ratio (R) can be manipulated by varying the diameters of the inner and outer coaxial supplies. Typically R>2 and Re>500 are needed to support turbulent flow and mixing. This specific invention demonstrates the production of NPs using an R=2.2 and a Re=2600.

The following examples illustrate particular properties and advantages of some of the embodiments of the present invention. Furthermore, these are examples of reduction to practice of the present invention and confirmation that the principles described in the present invention are therefore valid but should not be construed as in any way limiting the scope of the invention.

EXPERIMENTAL

FIG. 1 illustrates an exemplary reactor for the coaxial turbulent mixer. A 22 gauge needle 20 connected to a 50 mL syringe pump (New Era Pump Systems, Inc.) was inserted into a ¼ inch Swagelok four-way connector 22 and sealed with a Vespel/graphite ferrule (VG2). A perfluoroalkoxy (PFA) tube 24 was connected to the four-way connector 22 in line with the needle 20 so the needle is inserted into the PFA tubing 24. The flow from the needle 20 is referred to as the inner tube flow. Two 50 mL syringe pumps 26, 28 are connected to the four-way connector 22 adjacent to the needle connection to facilitate anti-solvent flow around the needle. The anti-solvent flow around the needle is referred to as the outer tube flow. The syringe pumps were controlled with SyringePumpProV1 software provided by the pump manufacturer. Both outer flow syringe pumps were set to 110 mL/min for a total outer tube flow of 220 mL/min and the inner tube flow was set at 10 mL/min, yielding an RE~2600.

Class V RDX (BAE OSI-Holston) was dissolved into acetone (technical grade, Ashland Chemical Co.) at concentrations of 0.5, 0.75, 1, 1.5, and 2 mg/mL then these solutions were injected through the inner tube. Hexane (HPLC grade, >98.5% purity) was used as the anti-solvent and cyclohexanone (ReagentPlus grade, 99.8% purity from Sigma Aldrich) was added as a surfactant at a ratio of 9:1 hexane to cyclohexanone which was introduced to the system through the outer tube.

Particle size distributions were determined using images from a scanning electron microscope (SEM, Hitachi NX9000). After the samples were collected, a single drop of the resulting mixture was placed on a silicon wafer attached to an SEM stub and quickly (<1 min) dried in a fume hood. The SEM was calibrated using a 4000×4000 pixel range and a calibration grid. Images were obtained using the lower secondary electron detector with an accelerating voltage of 1 kV and emission current of 30 μA. The SEM images were analyzed using Image J software for particle size distributions.

Results and Discussion

There are many variables to consider when using a coaxial turbulent jet mixer for the synthesis of energetic NPs to include, but not limited to, RDX, HMX, CL-20, PYX, and HNS. First, the flow regime affects particle size and is primarily identified by the Reynolds Number (RE) and the Flow Velocity Ratio (R). In short, two turbulent flow regimes are seen at high RE numbers, defined as a turbulent jet and turbulent vortex. NPs are produced when the flow regime is a turbulent jet. The transition between turbulent jet and turbulent vortex is determined by the value of R. High R values (>2) with high RE (>500) produce a turbulent jet and low R (<2) values with high RE (>500) produce a turbulent vortex. Another important variable to consider is the solubility of the constituent of interest in the solvent and the amount of anti-solvent required to precipitate that material out of solution. Increasing the outer flow (anti-solvent solution) will increase both RE and the amount of anti-solvent in the system. For this study, the anti-solvent flow was set to the operating limit of the syringe pumps (2 pumps at 110 mL/min) to maximize the RE (~2600) and maximize the amount of anti-solvent in the system. The inner flow was set to 10 mL/min which was the lowest setting that provided a high enough R value (2.2) for a turbulent jet. The lowest setting was used on the inner flow to be certain there was an adequate amount of hexane to precipitate the RDX out of solution.

Figure 2B:
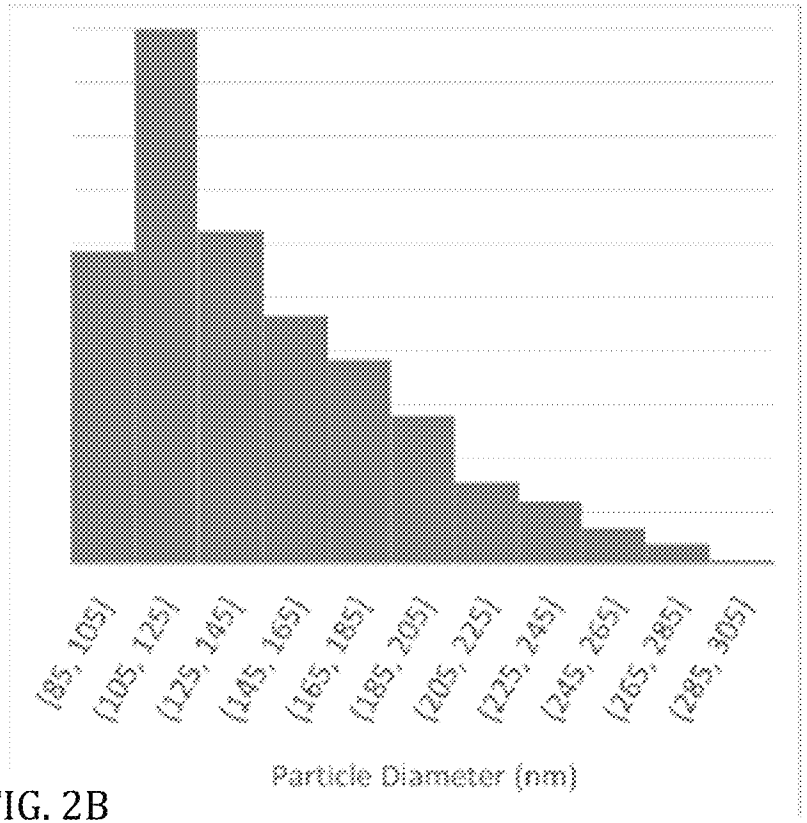
FIG. 2B presents a histogram of the 0.5 mg/mL sample, which is representative of the particle size distribution of all of the lower concentrations.
Figure 2C:
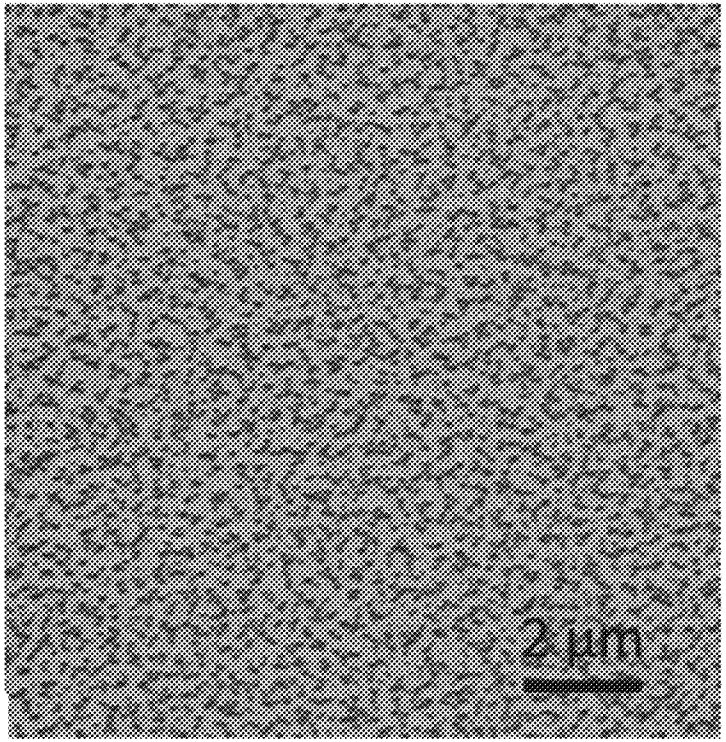
FIGS. 2C-2D present SEM images of the 0.5 mg/mL sample, which is representative of all the SEM images of the lower concentrations.
Figure 2D:
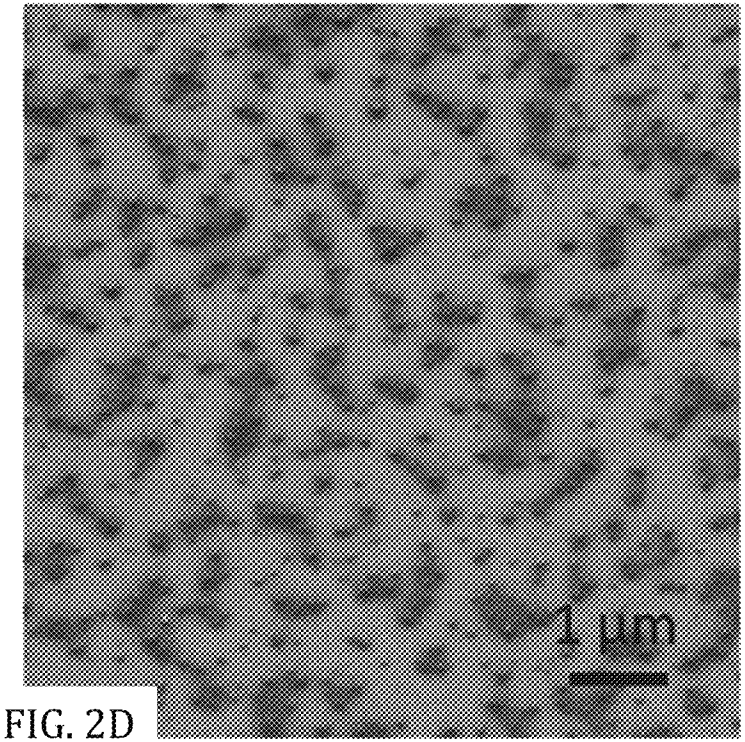
Figure 3:
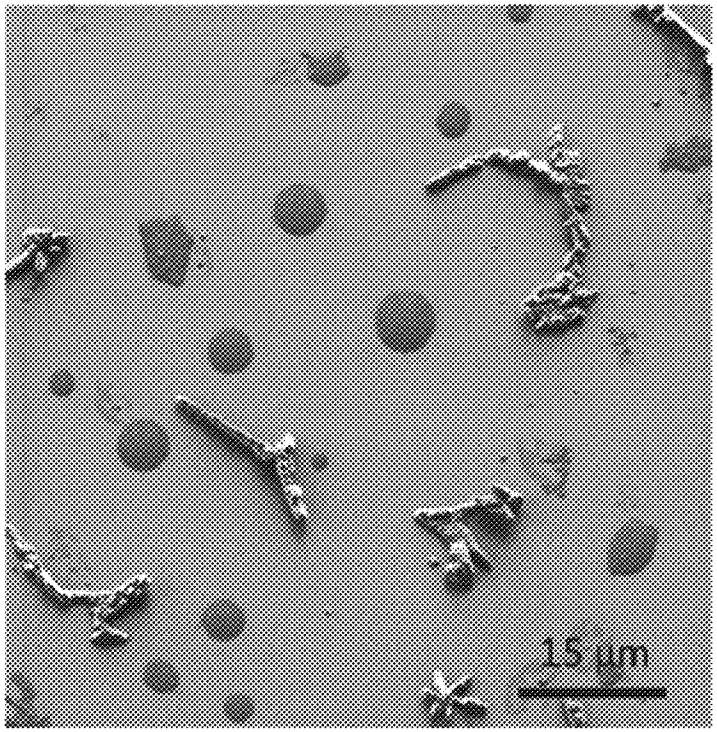
FIG. 3 presents a representative image of the rod shaped RDX.

Increasing the amount of solute in the solvent can potentially be employed to increase the production rate of RDX NPs. To determine the effect of solute concentration on particle diameter, the concentration of RDX in acetone in the inner flow was varied from 0.5 to 2 mg/mL. FIG. 2A shows the average particle size of lower RDX to acetone concentrations (i.e. 0.5, 0.75 and 1.0 mg/mL), FIG. 2B shows a histogram of the 0.5 mg/mL sample (which is representative of the particle size distribution of all of the lower concentrations), and FIGS. 2C-2D show SEM images of the 0.5 mg/mL sample (which is representative of all the SEM images of the lower concentrations). At higher RDX concentrations, the morphology and aspect ratio of the precipitated particles changes. In the samples produced from 1.5 and 2.0 mg/mL concentrations of RDX, the majority of the RDX particles were micron scale dendrite shaped rods sporadically decorated with NPs of RDX. A representative image of the rod shaped RDX is shown in FIG. 3. RDX concentrations of 1.5 and 2.0 mg/mL were analyzed for their particle size and distribution but not included in FIG. 2A due to their high aspect ratio which reflects a high degree of heterogeneity for the particle size and shape unlike the lower concentrations.

In FIG. 2A the average particle diameter for all concentrations below 1 mg/mL of RDX in acetone was 123 nm with a standard deviation of 28 nm. The error bars in FIG. 2A overlap, showing the particle sizes between the different concentrations were very similar and may not be statistically different. FIG. 2B shows the particle size distribution for the 0.5 mg/mL sample which is representative of all samples with concentrations less than 1 mg RDX/mL acetone, for a single inner tube flow concentration.

The distribution in FIG. 2B shows an average diameter of 120±35 nm and the mode of the distribution is between 105 and 125 nm. Dynamic light scattering (DLS) measurements were attempted but were unsuccessful due to the low concentration of RDX in the final solution (~90 mg/L) which is well below the measurement threshold for the instrument (10 mg/mL).

To confirm that the nanoparticle formation was induced by the conditions generated by turbulent mixing, 0.75 mg/mL of RDX in acetone was mixed with the hexane/cyclohexanone solution in a beaker without utilizing the turbulent mixer and the formation of micron size rod shaped particles, similar to FIG. 3, was observed. When cyclohexanone was not added, micron size rod shaped particles, were similarly observed. Thus NPs were observed only when cyclohexanone was mixed with hexane in the turbulent mixer. The cyclohexanone may act as a surfactant and reduce the effects of agglomeration and Oswalt ripening. While cyclohexanone was employed for the current invention, it is anticipated that other surfactants or surface coatings could be utilized to obtain similar results.

At a concentration of 1 mg RDX/mL acetone with anti-solvent flow at 220 mL/min and inner solvent flow at 10 mL/min, RDX NPs can be produced at 0.6 g/hour. Increasing the concentration of the inner tube solvent or increasing inner tube flow rate while maintaining precipitation of NPs would increase the production rate of RDX NPs synthesis (shown in Table 1).

TABLE 1

Rate and volume calculations

| Concentration (mg/ml) | Anti-Solvent Flow Rate (ml/min) | Inner Tube Flow Rate (ml/min) | Volume of Hexane (L) for 1 g RDX | Volume of Cyclohexanone(L) for 1 g RDX | nRDX Synthesis Rate (g/hour) |
|---|---|---|---|---|---|
| 0.5 | 220 | 10 | 39.6 | 4.4 | 0.3 |
| 0.75 | 220 | 10 | 26.4 | 2.9 | 0.45 |
| 1 | 220 | 10 | 19.8 | 2.2 | 0.6 |
| 2 | 220 | 10 | 9.9 | 1.1 | 1.2 |
| 1* | 110 | 20 | 9.9 | 1.1 | 1.2 |

(*Not tested in this study)

A major drawback to this method is the amount of anti-solvent needed as shown in Table 1 (~20 liters of hexane for 1 g RDX). However, the values shown in Table 1 are at the operating limits of the pumps. The pumps were set to the operating limits to eliminate flow rate variables (i.e. RE and R) and isolate the effects of solute concentration on particle diameter. Since the pumps were set to their operating limits, future optimization of flow rate variables will reduce the amount of solvent needed and increase the production rate of RDX NPs. For example, increasing inner tube flow rate will increase RDX NPs production rate and decreasing anti-solvent flow rate will reduce the amount of anti-solvent per gram of RDX NPs. In addition to optimization, reclamation of the solvent/anti-solvent can be employed to minimize waste and production cost.

To produce RDX NPs on an industrial scale, the process must either be scalable or a continuous flow process. One of the major disadvantages of previous methods is the inability to scale up and to be a continuous flow process. The turbulent mixer can easily be scaled by parallelization of reactors and each reactor can be modified to be a continuous flow reactor. In the continuous flow reactor, each individual pump may be replaced with a pair of pumps with large reservoirs of solvent and anti-solvent. Each pair of pumps may have one pump continuously infusing into the reactor while the other pump withdraws solvent or anti-solvent from the reservoirs using check valves to control the direction of flow. When the infusing pump is empty (and the withdrawing pump is full), their directions will be reversed allowing for continuous flow into the reactor. The combination of process optimization and a continuous flow coaxial turbulent mixer will allow for faster and more efficient production of RDX NPs.

Using a coaxial turbulent mixer, RDX NPs was synthesized at a rate of 0.6 g/hour. The particle diameter of the RDX NPs was 123±28 nm when the RDX to acetone concentration is 0.5, 0.75 and 1 mg/mL. When the concentration exceeds 1 mg RDX/mL acetone, elongated particles with greater than micron sized lengths were observed. In this study, the flow rate variables were set to the operating limits to isolate the effects of solute concentration on particle size. Optimization of these variables (inner solvent flow rate, anti-solvent flow rate, and cyclohexanone/hexane ratio) will lead to higher production rates and less volume of solvent.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A method of making RDX nanoparticles, comprising injecting a RDX/acetone solution having a concentration of RDX in acetone of 0.5-1.0 mg RDX/mL acetone through an inner tube of a turbulent mixer to form an inner flow;

injecting an anti-solvent through an outer tube of said turbulent mixer to form an outer flow, wherein the inner tube is concentric with the outer tube, wherein turbulent mixing of the inner flow and outer flow precipitates a plurality of nanoparticles of RDX having a size range of from 95 nm to 151 nm, an average size of 123 nm and a spherical morphology.

2. The method of claim 1, wherein the concentration of RDX in acetone is 1.0 mg RDX/mL acetone.

3. The method of claim 1, wherein the anti-solvent is a mixture of hexane and cyclohexanone.

4. The method of claim 3, wherein the ratio of hexane: cyclohexanone is 8:1-12:1.

* * * * *